United States Patent [19]

Rhind et al.

[11] 4,081,780

[45] Mar. 28, 1978

[54] EXPLOSION INHIBITING POTENTIOMETER ASSEMBLY AND DRIVE MECHANISM THEREFOR

[75] Inventors: Terence Keith Rhind; Allen Howe Andrews, both of Riverside, Calif.; Warren Emil Burdine, Prescott, Ariz.; John Matthew Hendrie, Riverside, Calif.

[73] Assignee: Bourns, Inc., Riverside, Calif.

[21] Appl. No.: 745,337

[22] Filed: Nov. 26, 1976

[51] Int. Cl.[2] ..... H01C 10/32

[52] U.S. Cl. ..... 338/164; 338/135; 338/143; 338/149; 338/184; 338/199

[58] Field of Search ..... 338/128–135, 338/143–149, 164, 184, 199; 285/DIG. 19, 321; 64/28 R, 30 R

[56] References Cited

U.S. PATENT DOCUMENTS

| | | | |
|---|---|---|---|
| 2,457,908 | 1/1949 | Meyerhoefer | 285/DIG. 19 |
| 3,080,735 | 3/1963 | Blom, Jr. et al. | 64/30 R X |
| 3,314,036 | 4/1967 | Kruse | 338/143 |
| 3,831,954 | 8/1974 | Longfellow | 285/DIG. 19 X |

*Primary Examiner*—C. L. Albritton

*Attorney, Agent, or Firm*—Paul H. Ware; William G. Becker

[57] ABSTRACT

A potentiometer contained within a housing is operated from the outside by means of an operating member which extends inward through an orifice in a housing wall. The operating member engages the potentiometer drive stem with the aid of an O-ring slip clutch, and includes a flange which is spring-urged against the interior housing wall to inhibit internal explosions from propagating to the outside.

3 Claims, 4 Drawing Figures

EXPLOSION INHIBITING POTENTIOMETER ASSEMBLY AND DRIVE MECHANISM THEREFOR

BACKGROUND OF THE INVENTION

This invention relates to potentiometer drive mechanisms, and more particularly to drive mechanisms for use with a potentiometer which must be physically isolated from the operator.

When pressure transducers and other instruments employing electrical potentiometers are operated in a volatile gaseous environment, it is very important that small explosions resulting from the electrical circuitry be contained within the potentiometer housing. If permitted to propagate outside the housing they can touch off a very severe explosion. There is thus a need to adequately seal the potentiometer housing. This need is balanced, however, by the need to have access to the potentiometers to make necessary adjustments. This problem is resolved in many cases by providing a removable housing cover which is merely taken off whenever an adjustment is made. This procedure adds to the time needed to make an adjustment, however, and also exposes the electrical circuitry within the housing to outside dirt and contaminants. Another approach uses a vernier screw and spring assembly to permit adjustments to be made from the outside, without exposing the interior of the housing. While this is a distinct advantage, only a somewhat coarse adjustment can be achieved with this method, and the vernier is subject to overstressing at the opposite limits of potentiometer rotation.

SUMMARY OF THE INVENTION

In view of these and other problems associated with the prior art, it is an object of the present invention to provide an electromechanical adjustment assembly in which a potentiometer contained within a housing is driven from the outside without danger of overstressing either the potentiometer or the drive mechanism, but which still effectively inhibits explosions within the housing from propagating to the outside.

Another object is the provision of such an assembly which is also relatively inexpensive and has an uncomplicated design.

A further object is the provision of such an assembly in which the potentiometer is not overstressed even when the adjustment mechanism is rotated beyond the potentiometer's limits of rotation.

In the accomplishment of these and other objects, the present invention provides an external operating mechanism for a rotatable drive potentiometer disposed internally within a housing, one wall of the housing have an orifice aligned with the potentiometer drive means. An operating member extends through the orifice with a stem engaging means to transmit rotations of the operating member to the potentiometer. A flange formed on the portion of the operating member within the housing is kept in area contact with the interior surface of the housing wall surrounding the orifice by means of a spring means retained between an exterior wall of the housing and a retaining means on the operating member. The described arrangement permits convenient adjustment of the potentiometer, while inhibiting outward propagation of an explosion inside the housing.

In a preferred embodiment the operating member compises a shaft with an axial bore to receive the potentiometer drive stem. An O-ring slip clutch is lodged in an annular groove within the bore and compressively engages the drive stem. The engagement between the O-ring and drive stem is such that the drive stem is rotated via the O-ring between opposite stops in the potentiometer in resonse to rotation of the operating shaft, while the O-ring slips against the drive stem when the operating shaft is rotated beyond the stop limits.

DESCRIPTION OF THE DRAWINGS

Further advantages and features of the invention will be apparent to those skilled in the art from the ensuing detailed description thereof, taken together with the accompanying drawings, in which.

DESCRIPTION OF A PREFERRED EMBODIMENT

Figure 1:
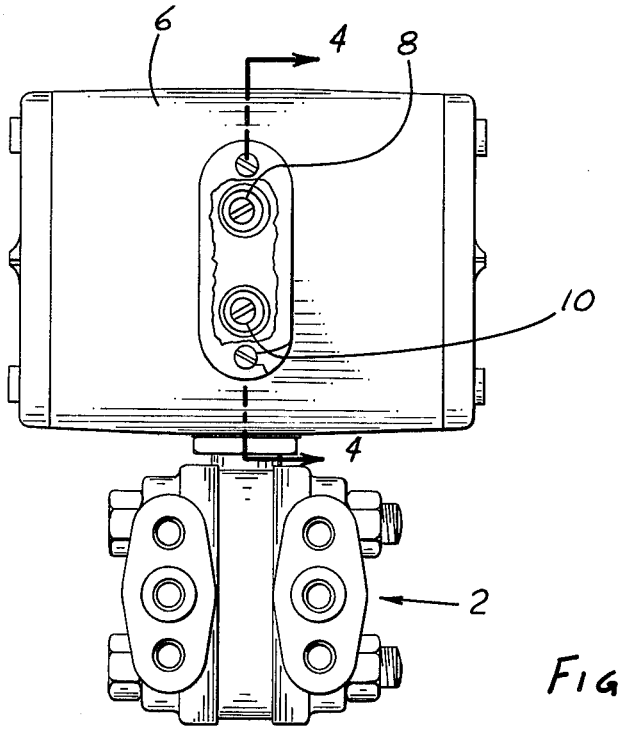
FIG. 1 is a plan view of a pressure transducer employing the potentiometer assembly of the present invention.

A potentiometer assembly within the scope of the present invention is shown in FIG. 1 employed in conjunction with a differential pressure transducer generally indicated by reference numeral 2. Such a transducer typically has a pair of diaphragms exposed to external pressures. The diaphragms flex in tandem to a position determined by the differential between the pressures applied to each. This position is sensed and converted to an electrical signal by means such as piezoelectric or potentiometer device. The structural details of such a transducer are well-known, and form no part of the present invention. Its electrical output is carried by lead wires through a sealed conduit 4 to a transmitter housing 6 which contains a pair of rotary potentiometers. One of the potentiometers adjusts the transducer range, and is controlled by an operating shaft 8 which extends outside of the housing. The other potentiometer adjusts the transducer zero, and is controlled by a second operating shaft 10.

Figure 2:
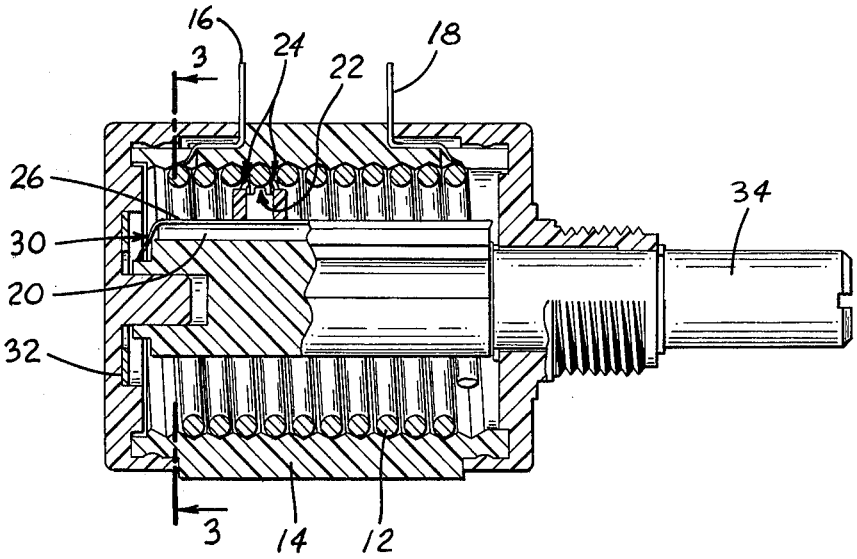
FIG. 2 is a sectional view of the potentiometer.
Figure 3:
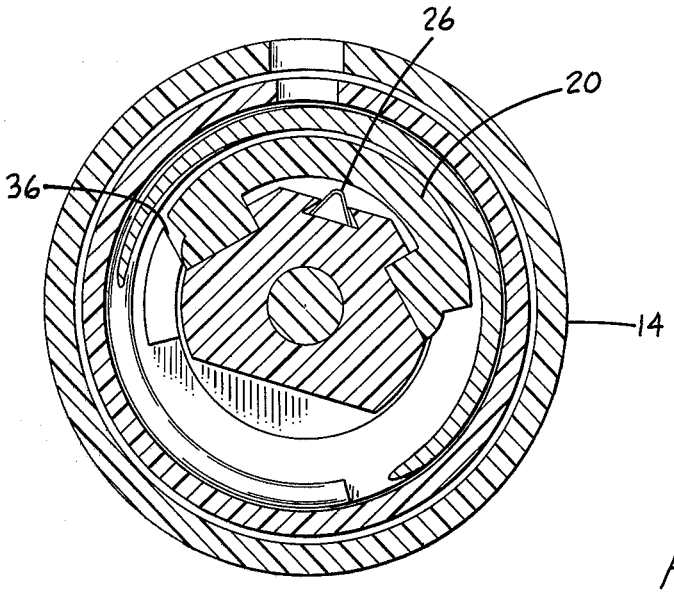
FIG. 3 is a sectional view taken along the line 3—3 of FIG. 2.

Each potentiometer is of well-known precision rotary construction, as shown in FIGS. 2 and 3. In this type of potentiometer resistance material is distributed along the surface of a helical coil 12 secured inside the potentiometer casing 14. Terminals 16 and 18 make electrical and physical contact with opposite ends of the coil such that substantially the full resistance value of the potentiometer is presented between them. A contact slider 20 has a metallic contact member 22 which wipes against the inner surface of resistance coil 12 and is guided along the coil strand by a pair of upstanding fingers 24. Slider 20 has been shifted to the left from the position shown in FIG. 2 for inclusion in FIG. 3. It makes electrical contact with and rides along a collector rail 26 on potentiometer rotor 28 as the rotor is burned, making a full 360° circuit around the resistance coil each time the rotor is rotated a full turn. Collector 26 terminates in a pair of fingers 30 which wipe against a terminal 32 to bring a signal from slider 22 out of the potentiometer. Rotor 28 is turned by a drive stem 34; in the embodiment shown ten full turns of stem 34 cause slider 20 to wipe against the resistance element all the way between end terminals. A stop 36 is provided at each end of the element to prevent slider 20 from traveling beyond the end terminals.

Housing 6 protects the potentiometers from the environment in which the transducer operates. As mentioned above, operating shafts 8 and 10 permit adjustment of the potentiometers from outside the housing. It is highly important that the openings through which the operating shafts pass be adequately sealed to prevent a limited explosion inside the housing from propagating to the outside and initiating a more severe explosion of any volatile gases present. Due to the electrical components within the housing, it is possible that arcing could initiate an internal explosion in situations where volatile gases have entered the housing, such as by a rupture in one of the transducer diaphragms or by leakage from the atmosphere into the housing.

Figure 4:
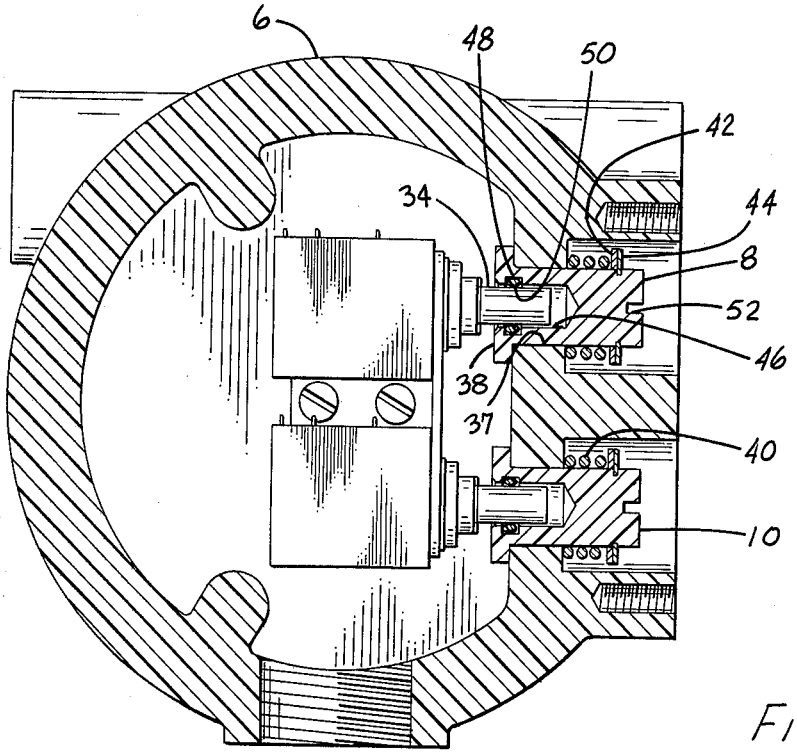
FIG. 4 is a sectional view taken along the line 4—4 of FIG. 1.

The structure employed in the present invention to enable operation of the potentiometers from outside the housing while effectively containing explosions within the housing is shown in FIG. 4. Since the operating mechanisms for both potentiometers are identical, only one need be described. Operating shaft 8 extends through an orifice 37 in the housing wall and has an annular flange 38 integrally formed at its inner end. A coil spring 40 is fit over the shaft on the outside of the housing and is retained in compression against the outer housing wall by a washer 42 and C-ring 44 snapped into a groove in the shaft. Spring 40 urges the shaft outward, thereby maintaining a broad area of contact between flange 38 and the inner housing wall surrounding the shaft orifice.

Potentiometer drive stem 34 is received in an axial bore 46 which extends into shaft 8 from its inner end. Inside the bore a resilient O-ring 48 is lodged in an annular groove 50 formed in the bore wall, and protrudes out of the groove to engage drive stem 34 about its circumference. O-ring 48 is formed from a stiffly deformable, springy material such as the fluorocarbon elastomer produced by the E. I. Du Pont de Nemours Company under the registered trademark VITON. In the embodiment shown groove 50 is 0.356 inch in diameter, drive stem 34 is 0.249 inch in diameter, and O-ring 48 has a 0.379 inch outside diameter, 0.239 inch inside diameter, and 0.140 inch cross-sectional diameter. It can thus be seen that the diameter of groove 50 exceeds that of drive stem 34 by an amount less than the cross-sectional diameter of O-ring 48. This compresses the O-ring against the drive stem and produces a frictionaL clutching action in which rotations of shaft 8 are transmitted through the O-ring to rotate the stem. The shaft is provided with a notch 52 at its outer end which may conveniently be engaged by a screwdriver to rotate the shaft.

The force of contact between O-ring 48 and drive stem 34 is sufficient to rotate the drive stem which shaft 8 is rotated and slider 20 is between stops 36. However, after slider 20 travels to the end of its travel and comes into contact with one of the stops 36, O-ring 48 slips against drive stem 34, operating shaft 8, or both if the operating shaft continues to be rotated beyond the stop. The potentiometer elements are thereby protected from being overstressed, while rotations of the operating shaft produce corresponding rotations of the drive stem when the potentiometer is within its operating range.

Should there be internal explosion, it is possible that some gases within housing 6 might be under sufficient pressure to be forced between operating shaft 8 and orifice 37. It has been found, however, that any such escaping gas generally cools off during the relatively long transmit from the housing interior to a temperature at which the danger of an explosion outside the housing has been alleviated. Internal explosions are thereby confined within the housing by the rather simple and uncomplicated structure described, while a slip clutch arrangement is achieved between the operating shaft and the potentiometer which permits the potentiometer to be readily adjusted without damaging either the internal potentiometer elements or the adjustment mechanism at the limits of its operating range.

While particular embodiment of the invention has been shown and described, numerous additional modifications and variations are possible in light of the above teachings. It is therefore intended that the scope of the invention be limited only in and by the terms of the appended claims.

What is claimed is:

1. In an electromechanical adjustment assembly which includes a housing, a potentiometer disposed internally within said housing, said potentiometer including a rotatable drive means, and an orifice in a wall of said housing aligned with said drive means, the improvement comprising an operating means for said potentiometer which comprises:

an operating shaft extending through said orifice, said shaft including a flange on the interior of said housing and a spring retaining means on the exterior of said housing, spring means retained between said retaining means and an exterior wall of said housing, said spring means urging said shaft outward to bring said flange into an area contact with the interior surface of said housing wall surrounding said orifice, thereby inhibiting outward propagation of an internal explosion within said housing, and means carried by said shaft for engaging said potentiometer drive means and transmitting thereto rotations of said shaft.

2. The assembly of claim 1, wherein said potentiometer drive means includes a drive stem extending outwardly toward said shaft, and the drive engaging means carried by said shaft comprises a slip clutch means held by said shaft in engagement with said stem, said slip clutch means rotating said stem in response to rotation of said shaft over the operating range of said potentiometer, and slipping against said stem when further stem rotation is blocked by said potentiometer.

3. The assembly of claim 2, said slip clutch means comprising a resilient O-ring held by said shaft in compression against the outer circumference of said stem.

* * * * *